US008704719B2

(12) United States Patent
Song et al.

(10) Patent No.: US 8,704,719 B2
(45) Date of Patent: Apr. 22, 2014

(54) MULTI-FUNCTION ANTENNA

(75) Inventors: Hyok Jae Song, Agoura Hills, CA (US); Carson R. White, Westlake Village, CA (US); James H. Schaffner, Chatsworth, CA (US); Arthur Bekaryan, Panorama City, CA (US); Eray Yasan, Canton, MI (US)

(73) Assignee: General Motors LLC, Detroit, MI (US)

( * ) Notice: Subject to any disclaimer, the term of this patent is extended or adjusted under 35 U.S.C. 154(b) by 413 days.

(21) Appl. No.: 12/952,992

(22) Filed: Nov. 23, 2010

(65) Prior Publication Data

US 2012/0127050 A1 May 24, 2012

(51) Int. Cl.
*H01Q 19/00* (2006.01)

(52) U.S. Cl.
USPC ..... 343/756

(58) Field of Classification Search
USPC ..... 343/756, 700 MS, 732
See application file for complete search history.

(56) References Cited

U.S. PATENT DOCUMENTS 5,124,713 A * 6/1992 Mayes et al. ..... 343/700 MS
5,543,386 A 8/1996 Findikoglu et al.
5,631,446 A 5/1997 Quan
5,689,216 A * 11/1997 Sturdivant ..... 333/33
5,973,648 A 10/1999 Lindenmeier et al.
6,032,054 A 2/2000 Schwinke
6,211,831 B1 4/2001 Nagy et al.
6,219,002 B1 * 4/2001 Lim ..... 343/700 MS
6,366,249 B1 4/2002 Jones et al.
6,417,747 B1 7/2002 Dearden et al.
6,424,300 B1 * 7/2002 Sanford et al. ..... 343/700 MS
6,617,943 B1 9/2003 Fazelpour
6,728,113 B1 4/2004 Knight et al.
6,765,574 B1 * 7/2004 Mao et al. ..... 345/428
6,795,741 B2 9/2004 Simon
6,847,276 B2 1/2005 Tamaki et al.
6,853,337 B2 2/2005 Barabash
6,861,991 B2 3/2005 Mueller et al.
7,015,860 B2 3/2006 Alsliety
7,053,845 B1 5/2006 Holloway et al.
7,079,082 B2 * 7/2006 Iskander et al. ..... 343/772
7,233,296 B2 6/2007 Song et al.
7,342,547 B2 3/2008 Maniwa et al.
7,427,961 B2 9/2008 Song et al.
7,710,325 B2 * 5/2010 Cheng ..... 343/700 MS (Continued)

OTHER PUBLICATIONS

Final Office Action, dated May 10, 2012, for U.S. Appl. No. 12/622,683.

(Continued)

*Primary Examiner* — Huedung Mancuso
(74) *Attorney, Agent, or Firm* — Ingrassia Fisher & Lorenz, P.C.

(57) ABSTRACT

An antenna includes a CPW transmission line and a radiating portion. The radiating portion is coupled to the CPW transmission line and is substantially coplanar with the CPW transmission line. The radiating portion is configured to produce a first linear polarization at a first frequency, a circular polarization at a second frequency, and a second linear polarization at a third frequency. The radiating portion includes a conductive material extending from the CPW transmission line and forming a plurality of openings in the radiating portion. The openings are asymmetric with respect to a first region of the radiating portion that is disposed on a first side of the CPW transmission line and a second region of the radiating portion that is disposed on a second side of the CPW transmission line.

17 Claims, 7 Drawing Sheets

(56) References Cited

U.S. PATENT DOCUMENTS

| | | | | |
|---|---|---|---|---|
| 8,098,205 | B2 * | 1/2012 | Rabinovich et al. | 343/713 |
| 2003/0103010 | A1 | 6/2003 | Boyle | |
| 2005/0219136 | A1 * | 10/2005 | Iskander et al. | 343/772 |
| 2008/0042903 | A1 * | 2/2008 | Cheng | 343/700 MS |
| 2009/0009399 | A1 * | 1/2009 | Gaucher et al. | 343/700 MS |
| 2009/0289852 | A1 * | 11/2009 | Li et al. | 343/700 MS |
| 2010/0164790 | A1 | 7/2010 | Wisnewski et al. | |
| 2011/0018656 | A1 * | 1/2011 | Lee et al. | 333/21 A |
| 2011/0037656 | A1 * | 2/2011 | Bremner et al. | 343/700 MS |

OTHER PUBLICATIONS

Response to Final Office Action, dated Jun. 29, 2012, for U.S. Appl. No. 12/622,683.
Notice of Allowance, dated Jul. 18, 2012, for U.S. Appl. No. 12/622,683.
Response to Office Action, dated Mar. 13, 2012, for U.S. Appl. No. 12/622,683.
Chen, C., et al., "Dual-band dual-sense circularly-polarized CPW-fed slot antenna with two spiral slots loaded," IEEE Transactions on Antennas and Propagation, Jun. 2009, pp. 1829-1833, vol. 57, No. 6.
U.S. Office Action, dated Dec. 13, 2011, for U.S. Appl. No. 12/622,683.
Hopf, J. F. et al. "Compact Multi-antenna System for Cars with Electrically Invisible Phone Antennas for SDARS Frequencies," 2nd International ITG Conference on Antennas, Mar. 2007, pp. 171-175.
Chiu, C-Y., et al. "Reduction of Mutual Coupling Between Closely-Packed Antenna Elements," IEEE Transactions on Antennas and Propagation, Jun. 2007, pp. 1732-1738, vol. 55, No. 6.
Andersen, J., et al. "Decoupling and Descattering Networks for Antennas," IEEE Transactions on Antennas and Propagation, Nov. 1976, pp. 841-846, vol. 24, No. 6.
Houdart, M., et al. "Various Excitation of Coplanar Waveguide," IEEE MTT-S International Microwave Symposium Digest, Apr. 1979, pp. 116-118, vol. 79, No. 1.
Lin, T.-H. "Via-free broadband microstrip to CPW transition," IEEE Electronic Letters, Jul. 19, 2001, pp. 960-961, vol. 37, No. 15.
Ellis, T.J., et al. "A wideband CPW-to-microstrip transition for millimeter-wave packaging," IEEE MTT-S International Microwave Symposium Digest, 1999, pp. 629-632, vol. 2.
Waterhouse, R.B., et al. "Small Folded CPW Fed Slot Antennas," IEEE Antennas and Propagation Society International Symposium, Jul. 2006, pp. 2599-2602.
Jan, J.-Y., et al. "Wideband CPW-fed Slot Antenna for DCS, PCS, 3G and Bluetooth Bands," IEEE Electronics Letters, Nov. 23, 2006, pp. 1377-1378, vol. 42, No. 24.
Sze, J.-Y., et al., "Circularly Polarized Square Slot Antenna With a Pair of Inverterd-L Grounded Strips," IEEE Antennas and Wireless Propagation Letters, 2008, pp. 149-151, vol. 7.
Bao, X., et al., "Dual-Frequency Dual-Sense Circularly-Polarized Slot Antenna Fed by Microstrip Line," IEEE Transactions on Antennas and Propagation, Mar. 2008, pp. 645-649, vol. 56, No. 3.
White, C. R., et al. "Connector Assembly and Method of Assembling a Connector Arrangement Utilizing the Connector Assembly," U.S. Appl. No. 12/622,683, filed Nov. 20, 2009.
White, C. R., et al. "Microwave Antenna Assemblies," U.S. Appl. No. 12/886,310, filed Sep. 20, 2010.
Song, H.J., et al. "Antenna System and Filter," U.S. Appl. No. 12/886,322, filed Sep. 20, 2010.
Office Action, dated Nov. 6, 2012, for U.S. Appl. No. 12/886,322.
Office Action, dated Oct. 26, for U.S. Appl. No. 12/886,310.
Robert A. Sainati, CAD of Microstrip for Wireless Applications, ISBN 0-89006-562-4, 1996, pp. 29-30 and 92-94.
Notice of Allowance, dated Sep. 13, 2012, for U.S. Appl. No. 12/622,683.
USPTO, Final Office Action in U.S. Appl. No. 12/886,310, mailed Apr. 5, 2013.
USPTO, Response to Final Office Action in U.S. Appl. No. 12/886,310, mailed Jun. 3, 2013.
USPTO, Notice of Allowance in U.S. Appl. No. 121886,310, mailed Nov. 25, 2013.

* cited by examiner 10
14
48
50
12
71
16
18
70
20
24
52
66
54
34
36
32
68
44
72
38
42
56
64
62
58
46
25
22
40
30
60
26
28

MULTI-FUNCTION ANTENNA

TECHNICAL FIELD

The technical field generally relates to antennas, and, more particularly, to antennas with multiple functions, for example for use in vehicles.

BACKGROUND

Antennas are used in vehicles, among other applications. A typical vehicle may use several antennas, such as, by way of example only, a cellular antenna, a personal communications service (PCS) antenna, a global positioning system (GPS) antenna, and a satellite radio antenna, among others. Typically, the vehicle has a different antenna performing each of these functions. Such multiple antennas may be mounted together on a vehicle, for example on a roof of the vehicle. However, such use and/or mounting of multiple antennas can be costly to manufacture and/or install on vehicles, and may occupy more than desired space on the vehicles.

Accordingly, it is desirable to provide an improved antenna, such as for use in connection with a vehicle, for example that provides increased functionality and/or reduced manufacturing and/or installation costs and/or that occupies reduced space on the vehicle. Furthermore, other desirable features and characteristics of the present invention will become apparent from the subsequent detailed description and the appended claims, taken in conjunction with the accompanying drawings and the foregoing technical field and background.

SUMMARY

In accordance with one example, an antenna is provided. The antenna comprises a coplanar waveguide (CPW) transmission line and a radiating portion. The radiating portion is coupled to the CPW transmission line, and is configured to produce a linear polarization at a first frequency and a circular polarization at a second frequency.

In accordance with another example, an antenna is provided. The antenna comprises a CPW transmission line and a radiating portion. The radiating portion is coupled to the CPW transmission line and is substantially coplanar with the CPW transmission line. The radiating portion is configured to produce a first linear polarization at a first frequency, a circular polarization at a second frequency, and a second linear polarization at a third frequency. The radiating portion comprises a conductive material extending from the CPW transmission line and forming a plurality of openings in the radiating portion. The plurality of openings are asymmetric with respect to a first region of the radiating portion that is disposed on a first side of the CPW transmission line and a second region of the radiating portion that is disposed on a second side of the CPW transmission line.

In accordance with a further example, an antenna is provided. The antenna comprises a CPW transmission line and a radiating portion. The radiating portion is coupled to the CPW transmission line, and is substantially coplanar with the CPW transmission line. The radiating portion is configured to produce a first linear polarization at a first frequency, a circular polarization at a second frequency, and a second linear polarization at a third frequency. The radiating portion comprises a conductive material extending from the CPW transmission line and forming a first strip of the radiating portion in contact with and perpendicular to the waveguide, a second strip of the radiating portion in contact with and perpendicular to the first strip, a third strip of the radiating portion in contact with the first strip and parallel to the second strip, a fourth strip of the radiating portion in contact with the second strip and the third strip and parallel to the first strip, and a first rectangular conductive region connected to the first strip and the second strip in a first region that is disposed on a first side of the CPW transmission line but not in a second region that is disposed on a second side of the CPW transmission line.

BRIEF DESCRIPTION OF THE DRAWINGS

Certain examples of the present disclosure will hereinafter be described in conjunction with the following drawing figures, wherein like numerals denote like elements, and wherein.

DETAILED DESCRIPTION

The following detailed description is merely exemplary in nature, and is not intended to limit the disclosure or the application and uses thereof. Furthermore, there is no intention to be bound by any expressed or implied theory presented in the preceding technical field, background, or the following detailed description.

Figure 1:
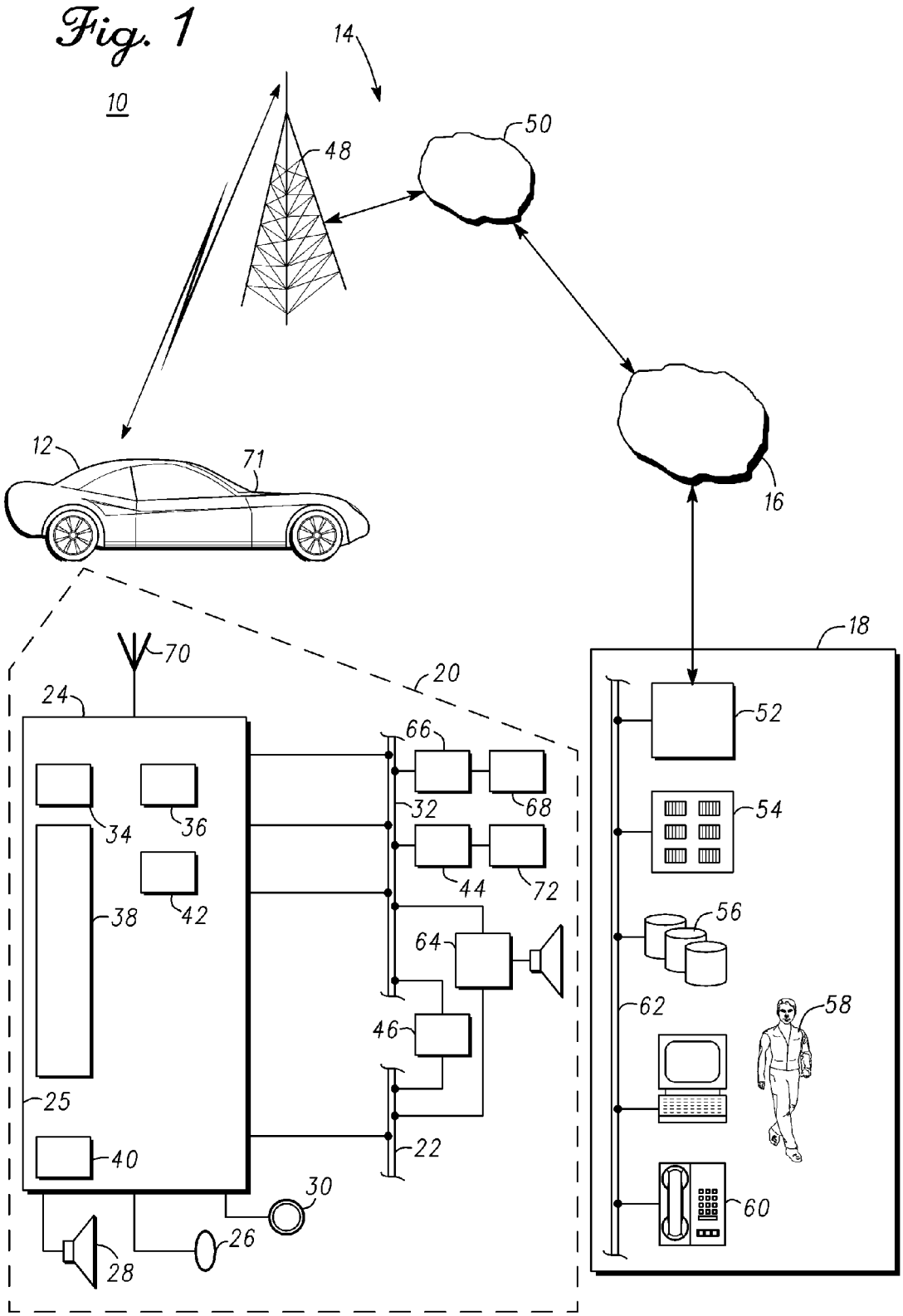
FIG. 1 is a schematic illustration of a non-limiting example of a communication system, including a telematics unit, for a vehicle.

With reference to FIG. 1, there is shown a non-limiting example of a communication system 10 that may be used together with examples of the systems disclosed herein. The communication system generally includes a vehicle 12, a wireless carrier system 14, a land network 16 and a call center 18. It should be appreciated that the overall architecture, setup and operation, as well as the individual components of the illustrated system are merely exemplary and that differently configured communication systems may also be utilized to implement the examples of the method disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, and the like, and is equipped with suitable hardware and software that enables it to communicate over communication system 10. Some of the vehicle hardware 20 is shown generally in FIG. 1 including a telematics unit 24, a microphone 26, a speaker 28, and buttons and/or controls 30 connected to the telematics unit 24. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard device that provides a variety of services through its communication with the call center 18, and generally includes an electronic processing device 38, one or more types of electronic memory 40, a cellular chipset/component 34, a wireless modem 36, a multiple mode antenna 70, and a navigation unit containing a GPS chipset/component 42. In one example, the wireless modem 36 includes a computer program and/or set of software routines adapted to be executed within the electronic processing device 38. The antenna 70 is configured to operate at various frequency bands, and produces linear and circular polarization, for example as depicted in FIGS. 2-11 and described further below in connection therewith. In one example, the antenna 70 is preferably mounted against or within a windshield 71 of the vehicle 12

The telematics unit 24 may provide various services including: turn-by-turn directions and other navigation-related services provided in conjunction with the GPS chipset/component 42; airbag deployment notification and other emergency or roadside assistance-related services provided in connection with various crash and/or collision sensor interface modules 66 and collision sensors 68 located throughout the vehicle; and/or infotainment-related services where music, internet web pages, movies, television programs, videogames, and/or other content are downloaded by an infotainment center 46 operatively connected to the telematics unit 24 via vehicle bus 32 and audio bus 22. In one example, downloaded content is stored for current or later playback. The above-listed services are by no means an exhaustive list of all the capabilities of telematics unit 24, but are simply an illustration of some of the services that the telematics unit may be capable of offering. It is anticipated that telematics unit 24 may include a number of additional components in addition to and/or different components from those listed above. The telematics unit 24 comprises and/or is implemented in connection with an antenna 70, for example as depicted in FIGS. 2-11 and described further below in connection therewith.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. In order to enable successful data transmission over the voice channel, wireless modem 36 applies some type of encoding or modulation to convert the digital data so that it can be communicated through a vocoder or speech codec incorporated in the cellular chipset/component 34. Any suitable encoding or modulation technique that provides an acceptable data rate and bit error rate can be used with the present examples. The antenna 70 services the GPS chipset/component 42 and the cellular chipset/component 34.

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with the telematics unit 24 or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more of the vehicle hardware 20 components. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The audio component 64 is operatively connected to the vehicle bus 32 and the audio bus 22. The audio component 64 receives analog information, rendering it as sound, via the audio bus 22. Digital information is received via the vehicle bus 32. The audio component 64 provides amplitude modulated (AM) and frequency modulated (FM) radio, compact disc (CD), digital video disc (DVD), and multimedia functionality independent of the infotainment center 46. Audio component 64 may contain a speaker system, or may utilize speaker 28 via arbitration on vehicle bus 32 and/or audio bus 22.

The vehicle crash and/or collision detection sensor interface 66 is operatively connected to the vehicle bus 32. The collision sensors 68 provide information to the telematics unit via the crash and/or collision detection sensor interface 66 regarding the severity of a vehicle collision, such as the angle of impact and the amount of force sustained.

Vehicle sensors 72, connected to various sensor interface modules 44 are operatively connected to the vehicle bus 32. Exemplary vehicle sensors include but are not limited to gyroscopes, accelerometers, magnetometers, emission detection, and/or control sensors, and the like. Exemplary sensor interface modules 44 include powertrain control, climate control, and body control, to name but a few.

Wireless carrier system 14 may be a cellular telephone system or any other suitable wireless system that transmits signals between the vehicle hardware 20 and land network 16. According to an example, wireless carrier system 14 includes one or more cell towers 48, base stations and/or mobile switching centers (MSCs) 50, as well as any other networking components required to connect the wireless carrier system 14 with land network 16. As appreciated by those skilled in the art, various cell tower/base station/MSC arrangements are possible and could be used with wireless carrier system 14. For example, a base station and a cell tower could be co-located at the same site or they could be remotely located, and a single base station could be coupled to various cell towers or various base stations could be coupled with a single MSC, to list but a few of the possible arrangements. A speech codec or vocoder may be incorporated in one or more of the base stations, but depending on the particular architecture of the wireless network, it could be incorporated within a Mobile Switching Center or some other network components as well.

Land network 16 can comprise a conventional land-based telecommunications network that is connected to one or more landline telephones, and that connects wireless carrier system 14 to call center 18. For example, land network 16 can include a public switched telephone network (PSTN) and/or an Internet protocol (IP) network, as is appreciated by those skilled in the art. Of course, one or more segments of the land network 16 can be implemented in the form of a standard wired network, a fiber or other optical network, a cable network, other wireless networks such as wireless local networks (WLANs) or networks providing broadband wireless access (BWA), or any combination thereof.

Call center 18 is designed to provide the vehicle hardware 20 with a number of different system back-end functions and, according to the example shown here, generally includes one or more switches 52, servers 54, databases 56, advisors 58, as well as a variety of other telecommunication/computer equipment 60. These various call center components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either the live advisor 58 or an automated response system, and data transmissions are passed on to a modem or other piece of telecommunication/computer equipment 60 for demodulation and further signal processing. The modem or other telecommunication/computer equipment 60 may include an encoder, as previously explained, and can be connected to various devices such as a server 54 and database 56. For example, database 56 could be designed to store subscriber profile records, subscriber behavioral patterns, or any other pertinent subscriber information. Although the illustrated example has been described as it would be used in conjunction with a manned call center 18, it will be appreciated that the call center 18 can be any central or remote facility, manned or unmanned, mobile or fixed, to or from which it is desirable to exchange voice and data.

Figure 2:
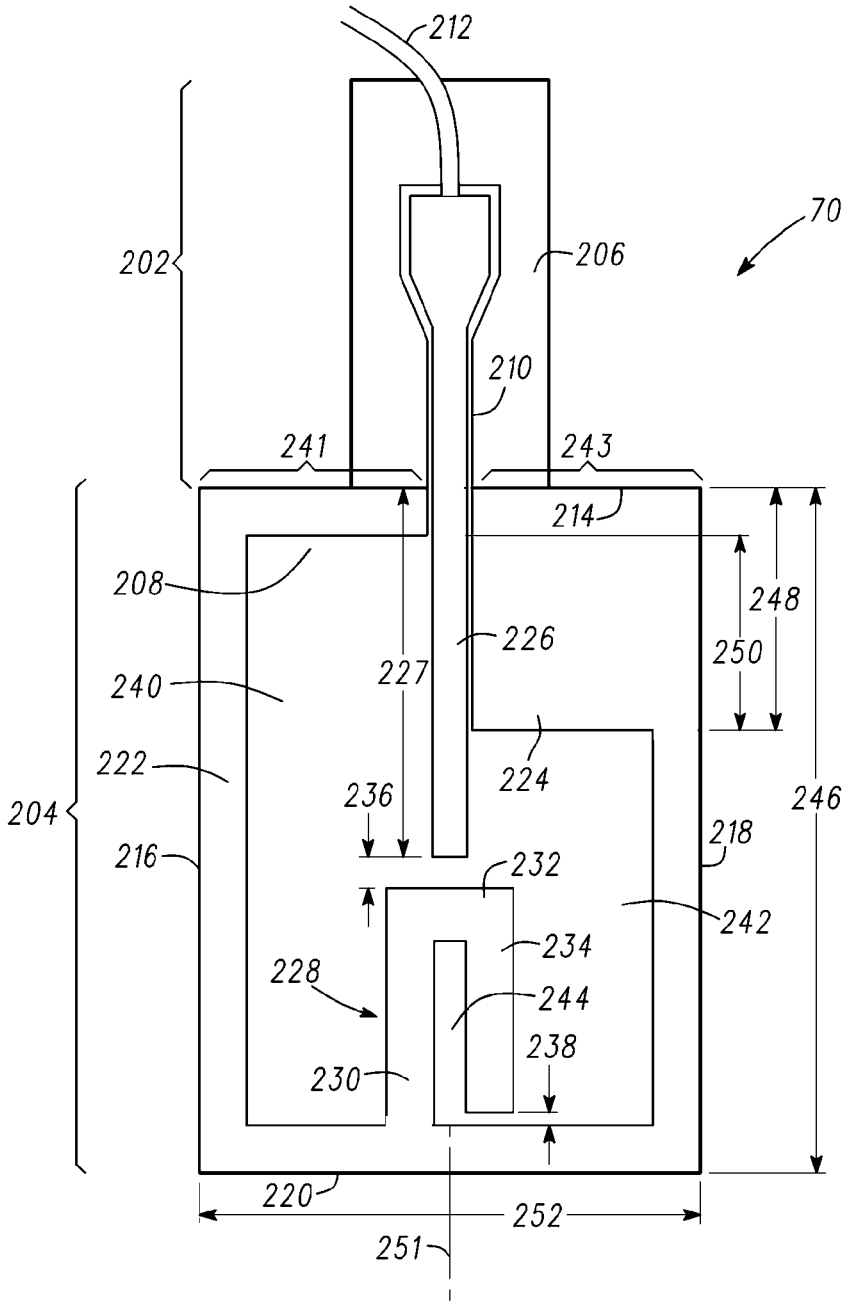
FIG. 2 is a schematic illustration of a non-limiting example of an antenna, which may be mounted in a windshield of and/or otherwise used in connection with the communication system, the vehicle, and the telematics unit of FIG. 1, shown from a top view.
Figure 3:
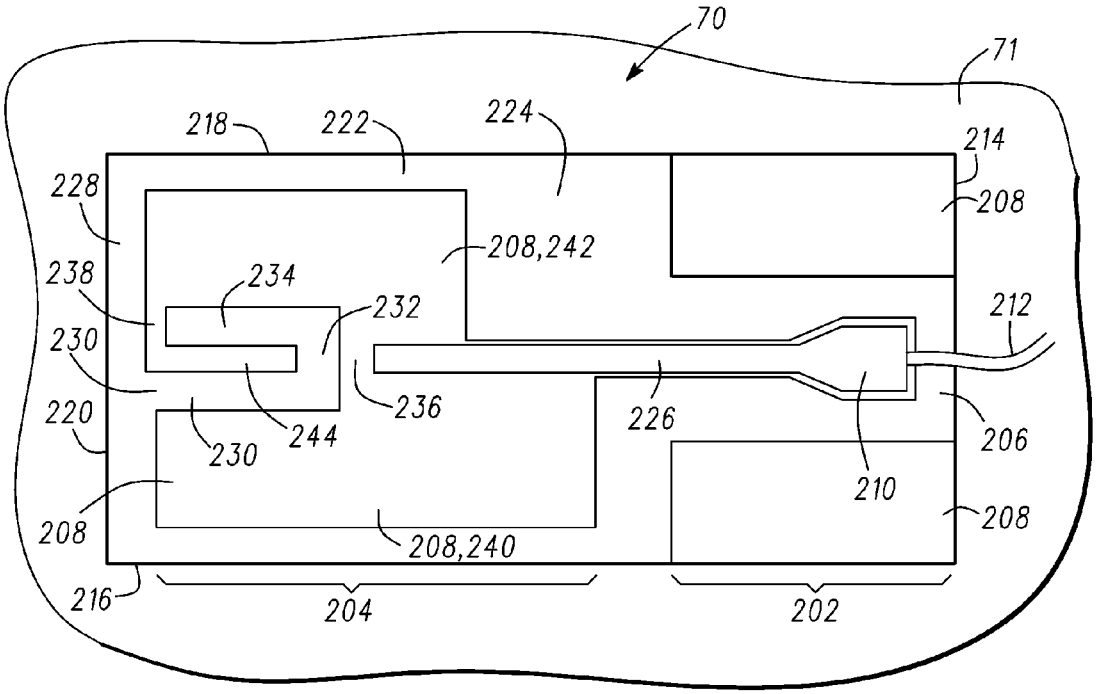
FIG. 3 is a schematic illustration of the antenna of FIG. 2, shown from a bottom view.

FIGS. 2 and 3 are schematic illustrations of a non-limiting example of an antenna 70. FIG. 2 depicts the antenna 70 from a top view, and FIG. 3 depicts the antenna from a bottom view that is opposite to or flipped from the view of FIG. 2. The antenna 70 preferably corresponds to the antenna 70 of the communication system 10 of FIG. 1, and preferably is used in connection with the communication system 10 and the telematics unit 24 of FIG. 1. The antenna 70 may be mounted on or within a windshield 71 of the vehicle 12 of FIG. 1, or otherwise on or within the vehicle 12. For example, as shown in FIG. 3, the antenna 70 may be mounted on an inside or interior portion of the windshield 71 of FIG. 1. In one preferred example, the antenna 70 has a size of approximately five centimeters in width and eleven centimeters in length.

The antenna 70 is a flat, planar, slot type antenna that is fed by a coplanar waveguide (CPW) transmission line 210. The CPW transmission line 210 comprises a signal conductor and ground conductor on both the left and right sides of the signal conductor. The antenna 70 operates at multiple frequencies, preferably including cellular frequencies, personal communications service (PCS) frequencies, global positioning system (GPS) frequencies, GLONASS (Global Navigation Satellite System) frequencies, and satellite radio frequencies, while also providing for linear and circular polarizations at different frequencies as required by such frequency bands. The antenna 70 provides these features with a single antenna structure and with a single feed that can help minimize the size and cost of providing such antenna functionality for the vehicle.

As depicted in FIGS. 2 and 3, the antenna 70 includes an upper region 202 and a lower region 204. Both the upper region 202 and the lower region 204 are flat and co-planar with one another, and include a conductive material 206 disposed on top of a substrate 208. In one example, the conductive material 206 comprises copper, and the substrate 208 comprises a thin film substrate, such as a thin film substrate sold under the trademark Kapton, which has the dielectric constant of approximately 3.4 to 3.5 and loss tangent (tan $\delta$=0.0015). Also in one example, the conductive material 206 has a thickness of between 0.2 and 1.0 mils (preferably approximately 0.5 mils), and the substrate 208 has a thickness of between one mil and three mils (preferably approximately two mils).

The upper region 202 is a non-radiating portion of the antenna 70. The upper region 202 includes the above-referenced coplanar waveguide transmission line 210 that is at least substantially flat and coplanar with the lower region 204. The CPW transmission line 210 is electrically coupled between the lower region 204 and a coaxial cable 212. In certain examples, the coaxial cable 212 may also be considered to be part of the antenna 70. In other examples, the coaxial cable 212 may be considered to be a separate component that is electrically coupled to the antenna 70.

Figure 4:
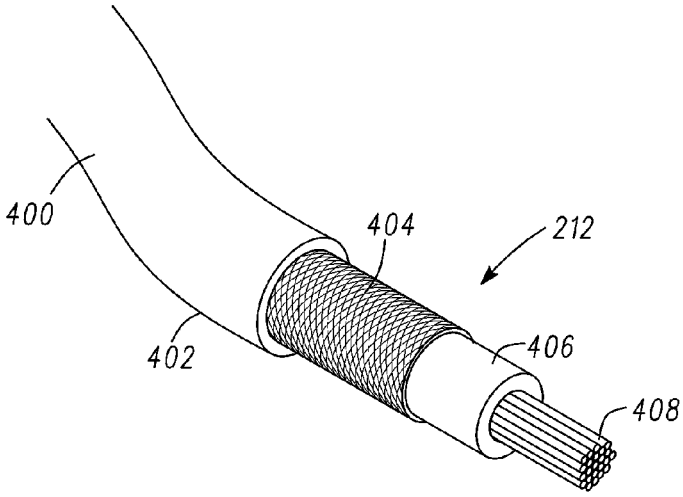
FIG. 4 is a schematic illustration of a portion of a non-limiting example of a coaxial cable that may be used in connection with the antenna of FIG. 2.
Figure 5:
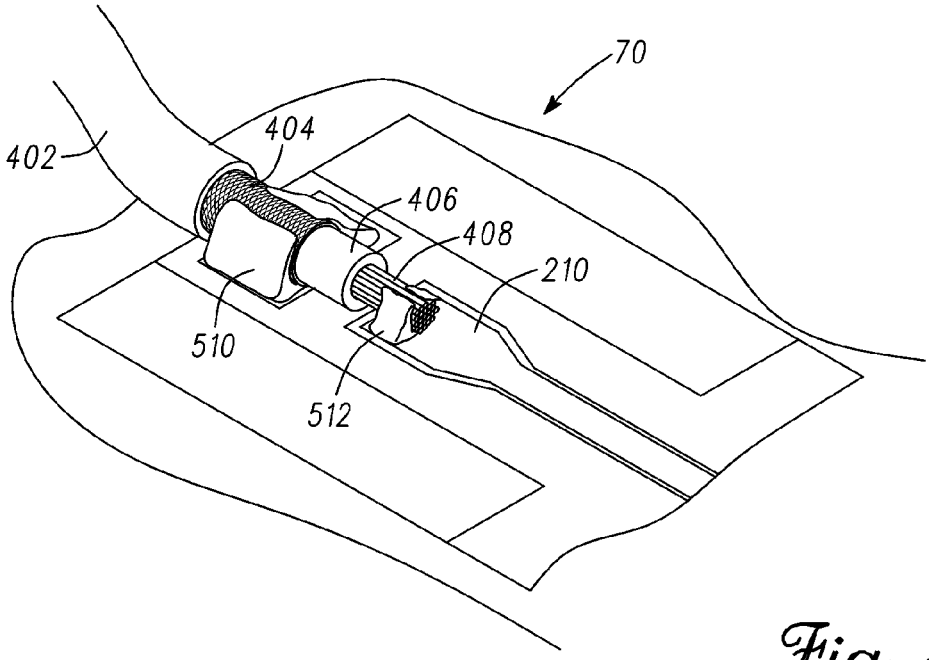
FIG. 5 is a schematic illustration of a portion of the coaxial cable of FIG. 4 shown as implemented in connection with the antenna of FIG. 2.

Turning briefly to FIGS. 4 and 5, an exemplary interface between the coaxial cable 212 and the CPW transmission line 210 is illustrated, in accordance with one example. Specifically, as shown in FIGS. 4 and 5, the coaxial cable 212 has an end 400 having a connector (e.g., an SMA connector, a Fakra connector, or the like) that can be connected to other components or systems, such as a receiver or a system that includes a receiver. The coaxial cable 212 also includes an outer jacket 402 (preferably made of PVC) that provides protection for the coaxial cable 212.

In addition, the coaxial cable 212 includes a braided shield 404, an insulator 406, and a center conductor 408. The CPW transmission line has a ground conductor 510 and a signal conductor 512. The braided shield 404 of the coaxial cable 212 is soldered onto the ground conductor 510 of the CPW transmission line 210. The center conductor 408 of the coaxial cable 212 is soldered onto the signal conductor 512 of the coplanar ground plane 210, and the signal conductor 512 is electrically coupled and connected to the lower region 204 of the antenna 70.

In certain examples, the interface between the coaxial cable 212 and the CPW transmission line 210 may vary. For example, if a clear conductive material 206 is desired, then the coaxial cable 212 may be interfaced with the CPW transmission line 210 in a manner such as that described in commonly assigned U.S. patent application Ser. No. 12/622,683, entitled "Connector Assembly and Method of Assembling a Connector Arrangement Utilizing the Connector Assembly", filed on Nov. 20, 2009, and incorporated herein by reference.

Returning now to FIGS. 2 and 3, the lower region 204 of the antenna 70 comprises a radiating portion 204 of the antenna 70. Although the radiating portion 204 utilizes a single CPW transmission line 210 and a single electrical feed therefrom, the radiating portion radiates at different frequencies, and provides linear and circular polarization as required at such various frequencies. The radiating portion 204 preferably operates in this manner for one or more cellular, PCS, GPS, GLONASS, and satellite radio frequency bands. In one example, the radiating portion 204 provides (i) vertical, linear polarization at one or more cellular bands (e.g., 824-894

MHz) and one or more PCS bands (e.g., 1850-1990 MHz); (ii) right hand circular polarization at one or more GPS bands (e.g., 1574.4-1576.4 MHz) and GLONASS (Global Navigation Satellite System) bands (e.g., 1598-1605 MHz); and (iii) left hand circular polarization at one or more satellite radio bands (e.g., 2332.5 to 2345 MHz).

Also as depicted in FIGS. 2 and 3, the conductive material 206 defines an outer periphery of the radiating portion 204 that comprises a first strip 214, a second strip 216, a third strip 218, and a fourth strip 220 of the radiating portion 204. As used herein, a strip includes an outer boundary or later of the conductive material 206. The first strip 214 of the radiating portion 204 is in contact with and is perpendicular to the CPW transmission line 210. The second strip 216 of the radiating portion 204 is in contact with and is perpendicular to the first strip 214. The third strip 218 of the radiating portion 204 is in contact with the first strip 214 and is parallel to the second strip 216. The fourth strip 220 of the radiating portion 204 is in contact with the second strip 216 and the third strip 218, and is parallel to the first strip 214. In the depicted example, a length 246 of the radiating portion 204 along the second strip 216 or the third strip 218 is within a range of 50 millimeters to 90 millimeters (most preferably approximately equal to 69 millimeters), and a width of the radiating portion 204 along the first strip 214 or the fourth strip 220 is within a range of 30 millimeters to 70 millimeters (and most preferably approximately equal to 50 millimeters).

The conductive material 206 also defines a conductive border 222 surrounding each of the first, second, third, and fourth strips 214, 216, 218 and 220. In a preferred example, the conductive border 222 is approximately 5 mm wide. However, this may vary.

In addition, the conductive material 206 defines a first rectangular conductive region 224, a second rectangular conductive region 226, and a non-rectangular conductive region 228, all within the radiating portion 204 of the antenna 70 (i.e., within the area encompassed by the first, second, third, and fourth strips 214, 216, 218, and 220). The first rectangular conductive region (or box) 224 is connected to the first strip 214 (or the conductive border 222 thereof) and the second strip 216 (or the conductive border 222 thereof). The first rectangular conductive region 224 is disposed in a second region 243 (depicted on the right hand side of the radiating portion 204 in FIG. 2) that is located on a second side of the CPW transmission line 210, but is not disposed in a first region 241 (depicted on the left hand side of the radiating portion 204 in FIG. 2) that is located on a second side of the CPW transmission line 210. This asymmetry with respect to the first and second regions 241, 243 helps to generate desired circular polarization by providing a phase difference of approximately 90°, for example at GPS, GLONASS, and satellite radio frequency bands. In the depicted example, the first rectangular conductive region 224 has a length 250 that is within a range of 15 millimeters to 35 millimeters (and most preferably equal to approximately 18 millimeters). The first rectangular conductive region 224 provides the necessary phase difference required for CP and helps the antenna structure resonate at broader frequencies by making the slot size smaller in the right side region, and is particularly important for making the antenna broadband in general.

The second rectangular conductive region 226 extends from the first strip 214 (or the conductive border 222 thereof) along a centerline 251 of the radiating portion 204. The second rectangular conductive region 226 is preferably longer and narrower than the first rectangular conductive region 224, and is preferably adjacent to the first rectangular conductive region 224. In the depicted example, the second rectangular conductive region 226 has a length within a range of 25 millimeters to 50 millimeters (and most preferably equal to approximately 37 millimeters). The second rectangular conductive region 226 extends closer to the fourth strip 220 than does the first rectangular conductive region 224. The second rectangular conductive region 226 is a transition region from the CPW 210 to asymmetric slot regions and excites the entire antenna structure. The second rectangular conductive region 226 is particularly important for creating vertical, linear polarization at the cellular frequency bands in conjunction with the bent strip 230, 232, 234.

The non-rectangular conductive region 228 is disposed by branching off the fourth strip 220. The non-rectangular conductive region 228 forms a bent in order to fit the long conducting path, which includes a first portion (or segment) 230, a second portion (or segment) 232, and a third portion (or segment) 234, within the conductive border 222.

The first portion 230 extends linearly from the fourth strip 220 (or the conductive border 222 thereof), and is perpendicular to the fourth strip 220. In the depicted example, the first portion 230 has a length that is within a range of 23 millimeters to 25 millimeters (and most preferably equal to approximately 24 millimeters), and a width that is within a range of 4.5 millimeters to 5.5 millimeters (and most preferably equal to approximately 4.8 millimeters).

The second portion 232 extends from the first portion 230, and is parallel to the fourth strip 220. In the depicted example, the second portion 232 has a length that is within a range of 12.5 millimeters to 13.5 millimeters (and most preferably equal to approximately 12.8 millimeters), and a width that is within a range of 5 millimeters to 6 millimeters (and most preferably equal to approximately 5.5 millimeters).

The third portion 234 extends from the second portion 232, and is parallel to the first portion 230. In the depicted example, the third portion 234 has a length that is within a range of 22 millimeters to 24 millimeters (and most preferably equal to approximately 23 millimeters), and a width that is within a range of 4.5 millimeters to 5.5 millimeters (and most preferably equal to approximately 4.8 millimeters).

Together, the first, second, and third portions 230, 232, and 234 form a bent microstrip shape for the non-rectangular conductive region 228. The non-rectangular conductive region 228 extends the antenna's resonance at cellular frequency bands, and is particularly important for creating vertical linear polarization at the cellular frequency bands.

Also as depicted in FIGS. 2 and 3, the radiating portion 204 includes various asymmetric openings (or gaps) that are formed, defined, and/or surrounded by the conductive material 206. The gaps represent regions in which the substrate 208 is present but the conductive material 206 is not present (and, specifically, include regions in which the substrate 208 is not directly covered, but that the regions are directly surrounded by, the conductive material 206). For example, during manufacture, the conductive material 206 may be scraped off or otherwise removed to leave the bare substrate 208 to form the open spaces (or gaps). The various openings (or gaps) are asymmetric, for example with respect to the first region 241 and the second region 243 of the radiating portion 204 of the antenna 70. The asymmetric configuration of the shapes, sizes, and locations of the various openings (or gaps) results in openings (or gaps) that resonate at different frequencies (as described in greater detail below) and introduce a ninety degree phase difference between two current paths from a signal strip of the CPW transmission line 210, and thereby generates desired circular polarizations at appropriate frequencies (such as, right hand circular polarization at GPS and GLONASS frequency bands and left hand circular polarization at satellite radio frequency bands).

Specifically, as depicted in FIGS. 2 and 3, a first opening (or gap) 236 is formed between a bottom portion of the second rectangular conductive region 226 and the second portion 232 of the non-rectangular conductive region 228. In the depicted example, the first gap 236 is within a range of 2 to 4 millimeters wide (most preferably equal to approximately 3 millimeters wide).

In addition, also as depicted in FIGS. 2 and 3, a second opening (or gap) 238 is formed between a bottom portion of the third portion 234 of the non-rectangular conductive region 228 and the fourth strip 220 (or the conductive barrier 222 thereof). In the depicted example, the second gap 238 is within a range of 0.5 to 1.5 millimeters wide (most preferably equal to approximately 1.3 millimeters wide).

A third opening (or gap) 240 is disposed within the first region 241 of the radiating portion 204 of the antenna 70. The third gap 240 is generally bounded by the second strip 216 (or the conductive border 222 thereof), the first strip 214 (or the conductive border 222 thereof), the second rectangular conductive region 226, the non-rectangular conductive region 228, and the fourth strip 220 or the conductive border 222 thereof). The third gap 240 is significantly larger than all of the other gaps, including the first and second gaps 236, 238 (described above) and the fourth and fifth gaps 242, 244 (described below). In the depicted example, the third opening 240 is within a range of 17 to 19 millimeters wide (most preferably equal to approximately 18.3 millimeters wide), and is within a range of 58 to 60 millimeters long (most preferably equal to approximately 59 millimeters long). The third opening 240 together with the base antenna structure 222 provides resonances at mid frequencies including the GPS frequency band.

A fourth opening (or gap) 242 is disposed within the second region 243 of the radiating portion 204 of the antenna 70. The fourth gap 242 is generally bounded by a bottom portion of the first rectangular conductive region 224, the third strip 218 (or the conductive border 222 thereof), the fourth strip 220 (or the conductive border 222 thereof), the non-rectangular conductive region 234, and the second rectangular conductive region 226. The fourth gap 242 is significantly larger than all of the other gaps, including the first and second gaps 236, 238 (described above) and the fifth gap 244 (described below), but is smaller than the third gap 240 (described above). In the depicted example, the fourth gap 242 is within a range of 17 to 19 millimeters wide (most preferably equal to approximately 18.3 millimeters wide), and is within a range of 39 to 41 millimeters long (most preferably equal to approximately 40 millimeters long). The fourth opening 242 together with the base antenna structure 222 provide resonances at higher frequencies including the XM frequency band.

In addition, a fifth opening (or gap) 244 is disposed near the centerline 251 of the radiating portion 204 of the antenna 70. The fifth gap 244 is generally bounded by the first, second, and third portions 230, 232, 234 of the non-rectangular conductive region 228 and the by the fourth strip 220 (or the conductive border 222 thereof). In the depicted example, the fifth gap 244 is within a range of 2 to 4 millimeters wide (most preferably equal to approximately 3.2 mm wide), and is within a range of 18 to 20 millimeters long (most preferably equal to approximately 18.7 millimeters long).

The fabricated antenna 70 can be installed or integrated onto the windshield 71 or window glass by applying dielectric adhesive on the non-conductor side of the antenna 70 and pressing the antenna 70 against the glass. In various examples, there may be multiple ways of integrating and/or installing the antenna on or within the windshield 71 or window glass. The antenna 70 can also be designed and fabricated for a standard non-flexible PCB. In one example, the antenna 70 can be housed in a non-conducting package and then installed onto the windshield 71 or window glass surface. In accordance with the example of FIG. 3, the fabricated antenna 70 was installed just behind the rear view mirror on the windshield 71 glass of a convertible type passenger vehicle.

Figure 6:
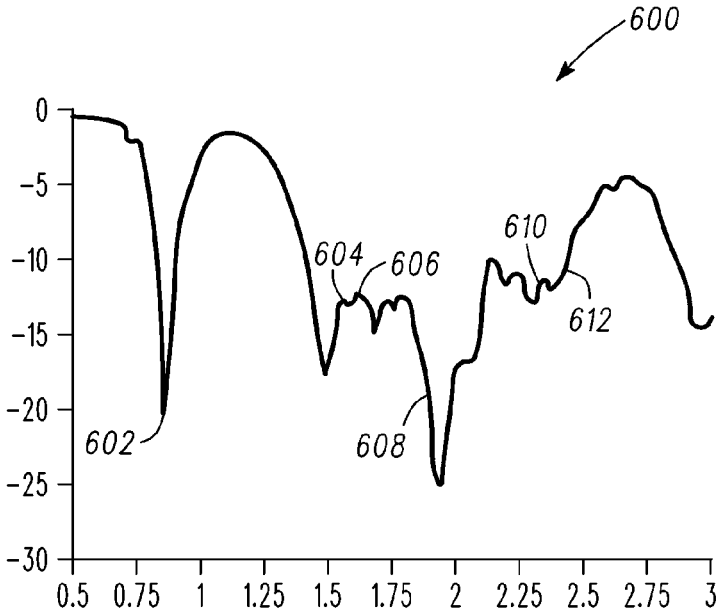
FIG. 6 is a graphical representation illustrating exemplary reflection coefficients of the antenna of FIG. 2 at different frequencies.

FIG. 6 includes a graphical representation 600 illustrating exemplary reflection coefficients of the antenna of FIG. 2 at different frequencies. Specifically, radiation patterns of the installed antenna were measured at various frequencies of the Cell, PCS, GPS and GLONASS bands in an anechoic chamber. On FIG. 6, the x-axis represents frequency (in GHz), and the y-axis represents the reflection coefficient (in dB). The graphical representation 600 displays a first resonance 602 at a cellular frequency band, a second resonance 604 at a GPS frequency band, a third resonance 606 at a GLONASS frequency band, a fourth resonance 608 at a PCS frequency band, a fifth resonance 610 at a satellite radio frequency band, and a sixth resonance 612 at a Wi-Fi frequency band. As shown in FIG. 6, the reflection coefficients are less than −10 dB for each of the above-referenced frequency bands, and the antenna 70 provides an excellent impedance match at each of these frequency bands.

Figure 7:
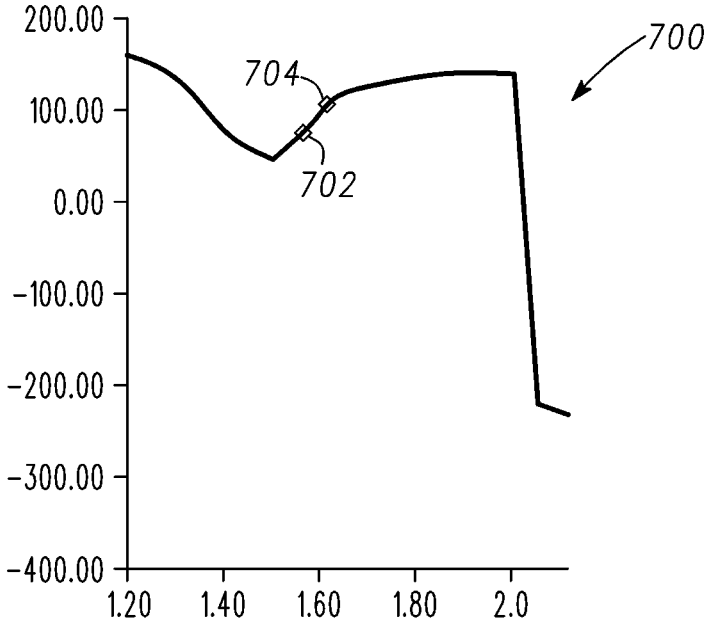
FIG. 7 is a graphical representation illustrating exemplary phase differences of the antenna of FIG. 2 at different frequencies.

FIG. 7 includes a graphical representation 700 illustrating exemplary phase differences of the antenna of FIG. 2 at different frequencies. Specifically, the graphical representation 700 represents a simulated phase difference between the two current paths, using finite element method (FEM) based software. The x-axis of the graphical representation 700 represents frequency (in GHz), and the y-axis represents phase difference (in degrees) between the two current paths. As is shown in FIG. 7, the phase difference is approximately 90 degrees (±15 degrees) at a first point 702 and a second point 704 over the GPS and GLONASS bands, respectively. The opposite sense of circular polarization can be obtained by simply exchanging the asymmetric slots, for example for use in connection with a satellite radio frequency band.

Figure 8:
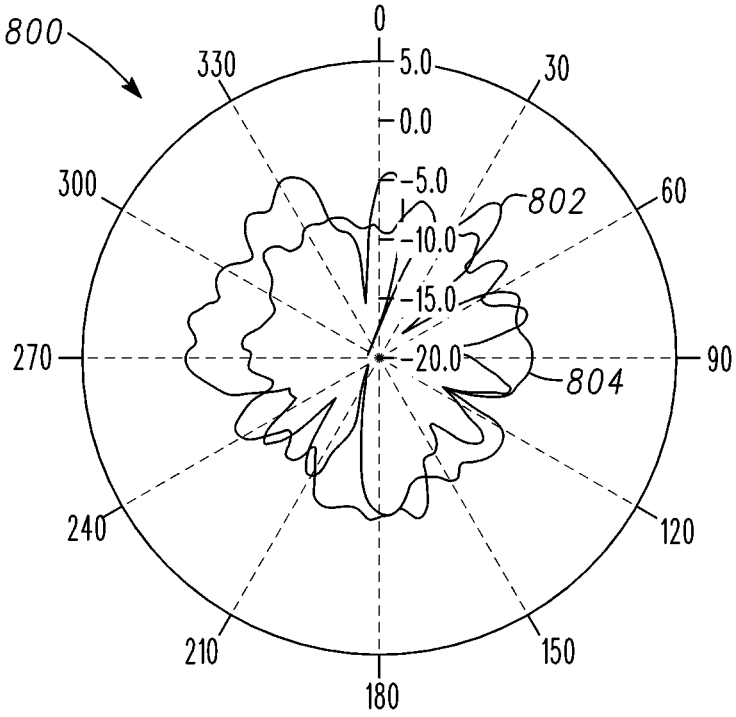
FIG. 8 is a graphical representation illustrating exemplary linearly polarized radiation patterns of the antenna of FIG. 2 at a cellular frequency band.
Figure 9:
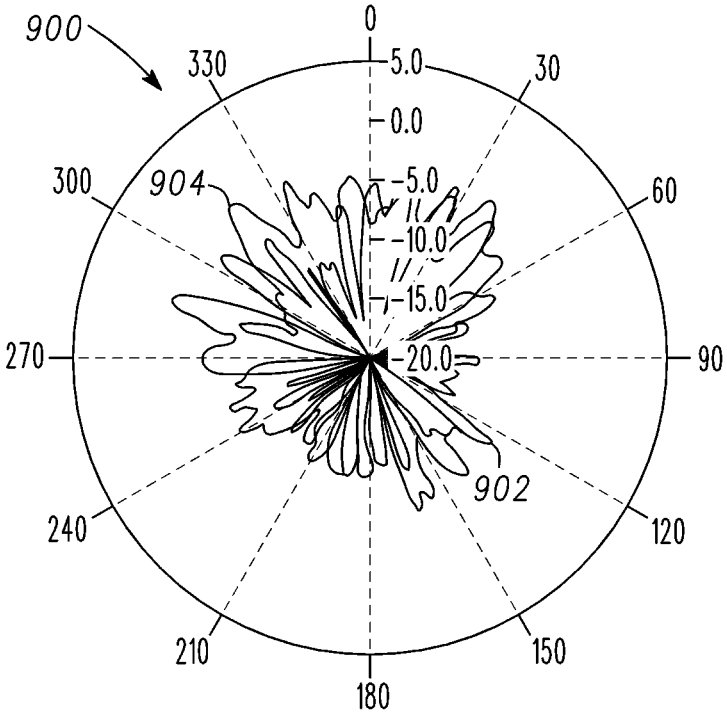
FIG. 9 is a graphical representation illustrating exemplary linearly polarized radiation patterns of the antenna of FIG. 2 at a PCS frequency band.
Figure 10:
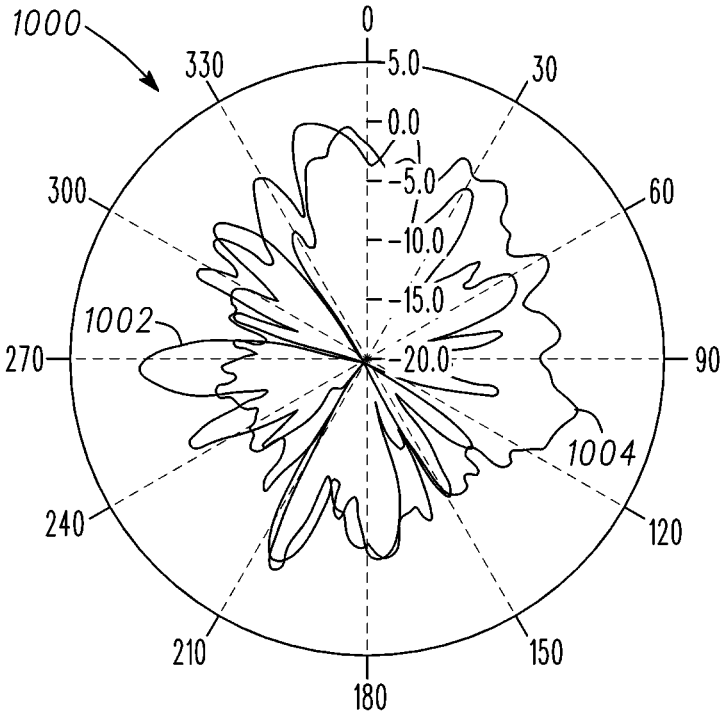
FIG. 10 is a graphical representation illustrating exemplary circular polarized radiation patterns of the antenna of FIG. 2 at a GPS frequency band.
Figure 11:
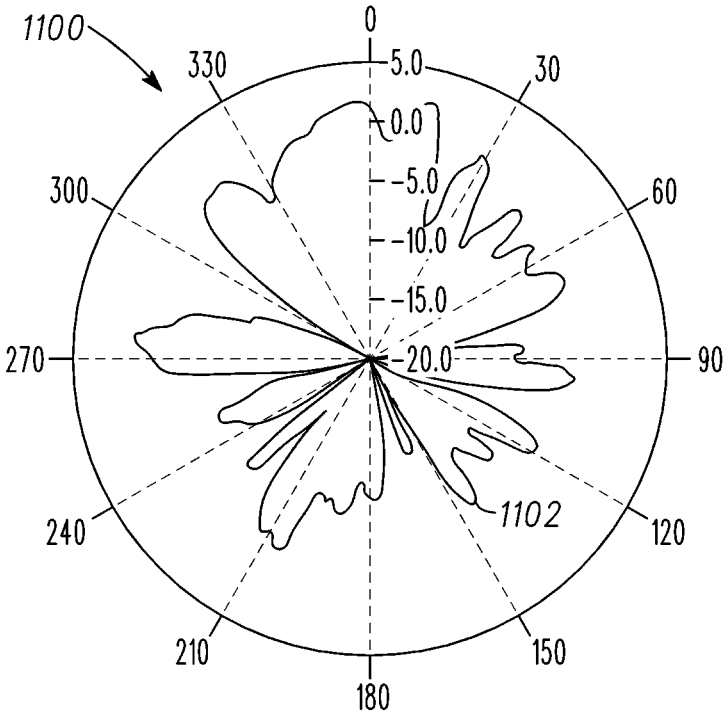
FIG. 11 is a graphical representation illustrating exemplary circular polarized radiation patterns of the antenna of FIG. 2 at a GLONASS frequency band.

FIGS. 8-11 provide graphical representations of various polarized radiation patterns of an example of the antenna 70 at various frequencies. Specifically, (i) FIG. 8 provides a graphical representation 800 of a vertical, linearly polarized radiation pattern 802 of an example of the antenna 70 at a cellular frequency band of 869 MHz and an elevation angle of 85 degrees with reference to zenith, along with a reference radiation pattern 804 of a reference production antenna under the same conditions; (ii) FIG. 9 provides a graphical representation 900 of a vertical, linearly polarized radiation pattern 902 of an example of the antenna 70 at a PCS frequency band of 1930 MHz and a reference elevation angle of 85 degrees, along with a reference radiation pattern 904 of a reference production antenna under the same conditions; (iii) FIG. 10 provides a graphical representation 1000 of a right hand circularly polarized radiation pattern 1002 of an example of the antenna 70 at a GPS frequency band of 1.575 GHz and a reference elevation angle of 60 degrees, along with a reference radiation pattern 1004 of a reference production antenna under the same conditions; and (iv) FIG. 11 provides a graphical representation 1100 of a right hand circularly polarized radiation pattern 1102 of an example of the antenna 70 at a GLONASS frequency band of 1.602 GHz and a reference elevation angle of 60 degrees.

The graphical representations of FIGS. 8-11 illustrate that the single, multi-functional antenna 70 provides antenna performance comparable to that of a production antenna at various different frequency bands with different polarization requirements. The single, multi-functional antenna 70 performs as well as or better than typical existing vehicle antenna modules having separate, individual antennas for each different frequency band. The single, multi-functional antenna 70 provides these functions with a single coaxial cable feed and a single CPW transmission line in a relatively flat and compact envelope, thereby providing for potential cost savings in manufacture and installation as well as reduced size and easier placement in vehicles of various types.

It will be appreciated that the disclosed systems and components thereof may differ from those depicted in the figures and/or described above. For example, the communication system 10, the telematics unit 24, and/or various parts and/or components thereof may differ from those of FIG. 1 and/or described above. Similarly, the antenna 70 and/or various parts or components thereof may differ from those of FIGS. 2-5 and/or described above, and/or the graphical results may differ from those depicted in FIGS. 6-11.

Similarly, it will be appreciated that, while the disclosed systems are described above as being used in connection with automobiles such as sedans, trucks, vans, and sports utility vehicles, the disclosed systems may also be used in connection with any number of different types of vehicles, and in connection with any number of different systems thereof and environments pertaining thereto.

While at least one example has been presented in the foregoing detailed description, it should be appreciated that a vast number of variations exist. It should also be appreciated that the detailed description represents only examples, and is not intended to limit the scope, applicability, or configuration of the invention in any way. Rather, the foregoing detailed description will provide those skilled in the art with a convenient road map for implementing the examples. It should be understood that various changes can be made in the function and arrangement of elements without departing from the scope of the invention as set forth in the appended claims and the legal equivalents thereof.

What is claimed is:

1. An antenna comprising:

a coplanar wave guide (CPW) transmission line; and a radiating portion coupled to the CPW transmission line, the radiating portion configured to produce a linear polarization at a first frequency and a circular polarization at a second frequency;

wherein:

the radiating portion comprises a conductive material extending from the CPW transmission line and forming a plurality of openings in the radiating portion, the plurality of openings being asymmetric with respect to a first region of the radiating portion that is disposed on a first side of the CPW transmission line and a second region of the radiating portion that is disposed on a second side of the CPW transmission line; and the conductive material defines:

a first strip of the radiating portion in contact with and perpendicular to the CPW transmission line;

a second strip of the radiating portion in contact with and perpendicular to the first strip;

a third strip of the radiating portion in contact with the first strip and parallel to the second strip;

a fourth strip of the radiating portion in contact with the second strip and the third strip and parallel to the first strip; and a first rectangular conductive region connected to the first strip and the second strip in the first region, but not in the second region.

2. The antenna of claim 1, wherein the radiating portion is substantially coplanar with the CPW transmission line.

3. The antenna of claim 1, wherein the radiating portion is further configured to produce a second linear polarization at a third frequency.

4. The antenna of claim 3, wherein:

the first frequency comprises a cellular frequency;

the second frequency comprises a global positioning system (GPS) frequency; and the third frequency comprises a personal communications service (PCS) frequency.

5. The antenna of claim 1, wherein the radiating portion is further configured to produce a right hand circular polarization at the second frequency and a left hand circular polarization at a fourth frequency.

6. The antenna of claim 5, wherein:

the second frequency comprises a GPS frequency; and the fourth frequency comprises a satellite radio frequency.

7. The antenna of claim 1, wherein the conductive material further defines:

a second rectangular conductive region extending from the first strip along a centerline of the radiating portion and extending closer to the fourth strip than does the first rectangular conductive region;

a non-rectangular conductive region disposed closer to the fourth strip than is the second rectangular conductive region;

a first gap between the second rectangular conductive region and the non- rectangular conductive region; and a second gap between the non-rectangular conductive region and the fourth strip, the second gap being asymmetric with the first gap.

8. The antenna of claim 7, wherein the non-rectangular conductive region comprises:

a first portion extending from the fourth strip and perpendicular to the fourth strip;

a second portion extending from the first portion and parallel to the fourth strip; and a third portion extending from the second portion and parallel to the first portion, the third portion separated from the fourth strip by the second gap.

9. An antenna comprising:

a coplanar wave guide (CPW) transmission line; and a radiating portion coupled to the CPW transmission line and substantially coplanar with the CPW transmission line, the radiating portion being configured to produce a first linear polarization at a first frequency, a circular polarization at a second frequency, and a second linear polarization at a third frequency, the radiating portion comprising a conductive material extending from the CPW transmission line and forming a plurality of openings in the radiating portion, the plurality of openings being asymmetric with respect to a first region of the radiating portion that is disposed on a first side of the CPW transmission line and a second region of the radiating portion that is disposed on a second side of the CPW transmission line;

wherein the conductive material defines:

a first strip of the radiating portion in contact with and perpendicular to the CPW transmission line;

a second strip of the radiating portion in contact with and perpendicular to the first strip;

a third strip of the radiating portion in contact with the first strip and parallel to the second strip;

a fourth strip of the radiating portion in contact with the second strip and the third strip and parallel to the first strip; and a first rectangular conductive region connected to the first strip and the second strip in the first region, but not in the second region.

10. The antenna of claim 9, wherein the radiating portion is further configured to produce a right hand circular polarization at the second frequency and a left hand circular polarization at a fourth frequency.

11. The antenna of claim 10, wherein:

the first frequency comprises a cellular frequency;

the second frequency comprises a global positioning system (GPS) frequency;

the third frequency comprises a personal communications service (PCS) frequency; and the fourth frequency comprises a satellite radio frequency.

12. The antenna of claim 9, wherein the conductive material further defines:

a second rectangular conductive region extending from the first strip along a centerline of the radiating portion and extending closer to the fourth strip than does the first rectangular conductive region;

a non-rectangular conductive region disposed closer to the fourth strip than is the second rectangular conductive region;

a first gap between the second rectangular conductive region and the non- rectangular conductive region; and a second gap between the non-rectangular conductive region and the fourth strip, the second gap being asymmetric with the first gap.

13. The antenna of claim 12, wherein the non-rectangular conductive region comprises:

a first portion extending from the fourth strip and perpendicular to the fourth strip;

a second portion extending from the first portion and parallel to the fourth strip; and a third portion extending from the second portion and parallel to the first portion, the third portion separated from the fourth strip by the second gap.

14. An antenna comprising:

a coplanar wave guide (CPW) transmission line; and a radiating portion coupled to the CPW transmission line, the radiating portion being substantially coplanar with the CPW transmission line and configured to produce a first linear polarization at a first frequency, a circular polarization at a second frequency, and a second linear polarization at a third frequency, the radiating portion comprising a conductive material extending from the CPW transmission line and forming a first strip of the radiating portion in contact with and perpendicular to the CPW transmission line;

a second strip of the radiating portion in contact with and perpendicular to the first strip;

a third strip of the radiating portion in contact with the first strip and parallel to the second strip;

a fourth strip of the radiating portion in contact with the second strip and the third strip and parallel to the first strip; and a first rectangular conductive region connected to the first strip and the second strip in a first region of the radiating portion that is disposed on a first side of the CPW transmission line but not in a second region of the radiating portion that is disposed on a second side of the CPW transmission line.

15. The antenna of claim 14, wherein:

the first frequency comprises a cellular frequency;

the second frequency comprises a global positioning system (GPS) frequency; and the third frequency comprises a personal communications service (PCS) frequency.

16. The antenna of claim 14, wherein the conductive material further defines:

a second rectangular conductive region extending from the first strip along a centerline of the radiating portion and extending closer to the fourth strip than does the first rectangular conductive region;

a non-rectangular conductive region disposed closer to the fourth strip than is the second rectangular conductive region;

a first gap between the second rectangular conductive region and the non- rectangular conductive region; and a second gap between the non-rectangular conductive region and the fourth strip, the second gap being asymmetric with the first gap.

17. The antenna of claim 16, wherein the non-rectangular conductive region comprises:

a first portion extending from the fourth strip and perpendicular to the fourth strip;

a second portion extending from the first portion and parallel to the fourth strip; and a third portion extending from the second portion and parallel to the first portion, the third portion separated from the fourth strip by the second gap.

* * * * *